US005385120A

United States Patent [19]

Keuper et al.

[11] Patent Number: 5,385,120

[45] Date of Patent: Jan. 31, 1995

[54] FLUID HEATER

[75] Inventors: Edward F. Keuper, La Crosse, Wis.; William J. Plzak, La Crescent, Minn.

[73] Assignee: Gas Research Institute, Chicago, Ill.

[21] Appl. No.: 106,052

[22] Filed: Aug. 12, 1993

[51] Int. Cl.[6] ..... F22B 7/00

[52] U.S. Cl. ..... 122/136 R; 122/160; 165/81

[58] Field of Search ..... 122/136 R, 149, 160, 122/161; 165/81, 83

[56] References Cited

U.S. PATENT DOCUMENTS

| | | | |
|---|---|---|---|
| 319,376 | 6/1885 | Wood . | |
| 1,764,960 | 6/1930 | Jones . | |
| 2,468,903 | 5/1949 | Villiger | 257/222 |
| 2,536,425 | 1/1951 | Daly | 122/145 |
| 2,998,060 | 8/1961 | Eckstrom | 159/28 |
| 3,183,967 | 5/1965 | Mettenleiter et al. | 165/83 |
| 3,850,231 | 11/1974 | Creek | 165/83 |
| 3,982,585 | 9/1976 | Gribsvad | 165/83 |
| 4,356,794 | 11/1982 | Bouman et al. | 122/161 X |
| 4,453,592 | 6/1984 | Wightman | 165/82 |
| 4,671,213 | 6/1987 | Horng | 122/136 |
| 4,742,800 | 5/1988 | Eising | 122/17 |
| 4,981,112 | 1/1991 | Adams et al. | 122/19 |
| 4,989,549 | 2/1991 | Korenberg | 122/136 X |

*Primary Examiner*—Edward G. Favors

*Attorney, Agent, or Firm*—McAndrews, Held & Malloy, Ltd.

[57] ABSTRACT

A fluid heater or boiler is disclosed which has a fire tube or combustion chamber surrounded by a reservoir containing a fluid to be heated. The combustion chamber is defined by an inner shell and the reservoir is defined by an outer shell. The inner and outer shells are joined by one or more flue tubes which are thermally expandable along the axes connecting their points of attachments to the inner and outer shells. The heater is constructed so that the inner shell is deflected relative to the outer shell, when the flue tubes or inner shell expand or contract, thus accommodating the thermal expansion. The flue tubes may optionally be adapted to flex perpendicularly to their axes, as well as deflecting the inner shell, to accommodate thermal expansion. The inner shell may also be suspended within the outer shell by the flue tubes connecting the inner and outer shells.

15 Claims, 1 Drawing Sheet

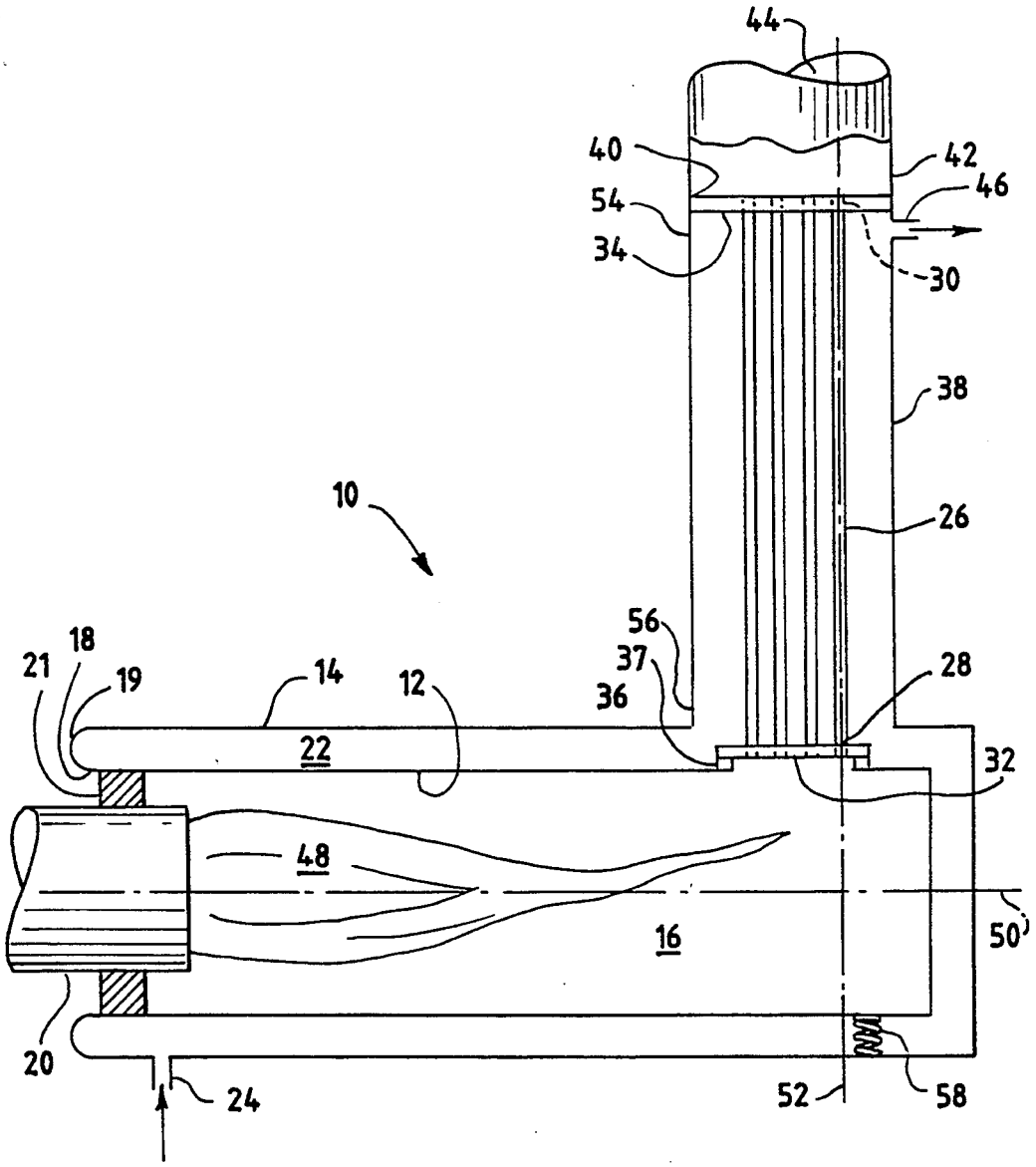
44
40
42
46
54
34
30
38
10
26
56
37
36
28
21
18
19
14
12
22
32
48
16
50
20
24
52
58

FLUID HEATER

BACKGROUND OF THE INVENTION

The present invention relates to a fluid heater, or what is commonly referred to as a boiler. More particularly, the present invention relates to a fluid heater which accommodates thermal expansion and contraction.

A typical fluid heater comprises a fire tube or combustion chamber where a fuel is burned and hot combustion gases are generated, and one or more flue tubes for discharging the hot gases from the combustion chamber. An outer shell at least partially surrounding the combustion chamber and flue tubes forms a reservoir which contains a fluid, so the fluid is in contact with the external surfaces of the combustion chamber and the flue tubes. As the hot gases travel from the fire pot through the flue tubes, heat is transferred to the surrounding fluid.

Typically, flue tubes are joined at one end to the outer shell, and joined at the other end to the combustion chamber. The combustion chamber and outer shell are also joined together by other structure. This design requires the provision of a way to accommodate the thermal expansion and contraction of the flue tubes with respect to the combustion chamber and outer shell.

There are known devices which have addressed this problem. For example, expansion rings between the flue tubes and the fire pot, expansion rings between the flue tubes and the outer shell, bellows for connecting the flue tubes to the outer shell, flexible joints and a telescoping relationship between flue tubes and a gas inlet channel have been used for this purpose.

SUMMARY OF THE INVENTION

It is an object of the present invention to provide a fluid heater that is capable of accommodating the thermal expansion of the flue tubes without the use of flexible or telescoping connections between the flue tube and the combustion chamber, or between the flue tube and the outer shell.

Another object of the present invention is to provide a fluid heater having a combustion chamber which is secured within a fluid reservoir in such a manner that it can be deflected with respect to the fluid reservoir to accommodate expansion or contraction of flue tubes which are connected between the walls of the combustion chamber and the fluid reservoir.

A further object of the invention is to provide a fluid heater wherein the combustion chamber is at least partially supported by the flue tubes.

Other objects and advantages of the invention will become apparent upon reading the following detailed description and appended claims, and upon reference to the accompanying drawings.

In accordance with the present invention thermal expansion and contraction of the flue tubes, the combustion chamber, or both is accommodated by a deflection of the combustion chamber with respect to the outer shell. This arrangement allows simple rigid connections between the flue tubes and both the outer shell and the combustion chamber.

The fluid heater of the present invention comprises an inner shell, an outer shell, and flue tubes. The inner shell defines and encloses a combustion chamber. The outer shell surrounds at least a portion of the inner shell. The inner and outer shells define between them a generally annular reservoir for containing the fluid to be heated.

At least one thermally-expandable flue tube extends from the inner shell through the reservoir to the outer shell. The flue tube has an inlet which is connected to the inner shell and communicates with the combustion chamber. The flue tube also has an outlet, which is connected to the outer shell, and communicates through an aperture in the outer shell.

In this configuration, hot flue gases pass from the combustion chamber through the flue tube and to a space external to the outer shell. As the temperature of the flue tube and the combustion chamber change, they undergo thermal expansion or contraction. An axis connecting the inlet and the outlet of the flue tube defines a direction of thermal expansion or contraction of the flue tube. As used in this specification, a structure which accommodates thermal expansion is defined to include any structures which accommodate thermal contraction.

Responsive to the thermal expansion of the flue tube and the combustion chamber, the inner shell is deflected with respect to the outer shell. This deflection of the inner shell accommodates the thermal expansion of the flue tube and the combustion chamber.

The present invention reduces or eliminates the need for flexible or telescopic connections between the inner and outer shells. This arrangement permits simple, substantially rigid connections between the flue tubes and the combustion chamber and between the flue tubes and the outer shell. Additionally, the rigid connections between the flue tubes, the outer shell, and the combustion chamber provide support for the combustion chamber.

BRIEF DESCRIPTION OF THE DRAWINGS

FIG. 1 is a schematic sectional view of the fluid heater of the present invention.

DETAILED DESCRIPTION OF THE PREFERRED EMBODIMENT OF THE INVENTION

FIG. 1 shows the fluid heater 10 comprising an inner shell 12 and an outer shell 14. In this embodiment, the shells 12 and 14 are concentric cylinders, but they can be other shapes, non-concentric, or the inner shell 12 can be a different shape from the outer shell 14.

The inner shell 12 defines a combustion chamber 16, having a combustion chamber opening or aperture 18 for the introduction of a burner 20. The burner 20 may be an open flame, radiant, or other type of heat source that emits gases, within the scope of the invention. The outer shell 14 surrounds the inner shell 12 and is continuous with the inner shell 12 along a generally annular common wall or element or lip 19 defining the perimeter of the combustion chamber opening 18, such that the inner shell 12 is in re-entrant relationship with the outer shell 14. A reservoir 22 is defined by the space between the inner shell 12 and the outer shell 14. An insulating ring 21 prevents the escape of heat and combustion gases through the combustion chamber opening 18, and can provide support for the burner 20. A fluid inlet opening 24 permits the introduction into the reservoir 22 of the fluid to be heated. Optionally, a plurality of inlet openings may be provided to increase or distribute the fluid flow into the reservoir.

The fluid heater 10 further comprises a plurality of flue tubes, such as the flue tube 26. The flue tube 26 has an inlet 28 and an outlet 30. The inlet 28 of the flue tube 26 is continuous with a lower tube sheet 32. The outlet 30 of the flue tube 26 is continuous with an upper tube sheet 34.

The inner shell 12 has an exhaust opening 36. The dimensions of the exhaust opening 36 can be slightly less than the dimensions of the lower tube sheet 32, such that the lower tube sheet 32 can be fastened to the exhaust opening 36 along their respective perimeters. Thus, the combustion chamber 16 communicates with the inlet 28 of the flue tube 26. A reinforcing ring 37 can be provided to reinforce the inner shell 12 at the exhaust opening 36. A stack 38 surrounds the plurality of flue tubes such as 26. The stack 38 is an extension of the outer shell 14, such that the stack 38 defines a portion of the reservoir 22. Thus, the plurality of flue tubes such as 26 is positioned within the reservoir 22.

The stack 38 has a stack opening or aperture 40. The dimensions of the stack opening 40 are substantially the same as the dimensions of the upper tube sheet 34, such that the upper tube sheet 34 may be connected to the stack opening 40 along their respective perimeters. A chimney 42, having an interior 44, is positioned over the upper tube sheet 34 such that the outlet 30 of the flue tube 26 communicates with the interior 44 of the chimney 42.

A fluid outlet opening 46 is provided in the stack 38 and positioned near the upper tube sheet 34. The fluid outlet opening 46 permits the discharge of fluid that has been heated by the fluid heater 10. Optionally, a plurality of fluid outlets may be provided to increase or distribute the fluid flow from the reservoir.

In operation, the burner 20 injects a flame 48 into the combustion chamber 16. Hot combustion gases leave the combustion chamber 16 by passing through the exhaust opening 36, through the inlets 28 of the flue tubes 26, through the flue tubes 26, out the outlets 30 of the flue tubes 26, into the interior 44 of the chimney 42, and finally up the chimney 42. Heat from the combustion gases is conducted through the inner shell 12 and the walls of the flue tubes 26 and absorbed by the fluid contained in the reservoir 22, including the portion of the reservoir 22 defined by the stack 38. The fluid passes into the fluid inlet opening 24, through the reservoir 22, up the stack 38, and out the fluid outlet opening 46.

The combustion chamber 16 has a combustion chamber axis 50 which, in this particular embodiment, is substantially horizontal and common to the inner shell 12 and the outer shell 14. The flue tube 26 has a flue tube axis 52 which passes through the inlet 28 and the outlet 30 of the flue tube 26. In this particular embodiment of the present invention, the flue tube axis 52 is substantially vertical. The stack 38 has a distal end 54 and a proximal end 56 relative to the axis 50.

During operation, as the temperature of the flue tube 26 changes, the flue tube 26 thermally expands or contracts along the flue tube axis 52, tending to push the tube sheets 32 and 34 apart or pull them together. This thermal expansion or contraction is accommodated by deflection of the inner shell 12 with respect to the outer shell 14. The deflection of the inner shell 12 is partially accomodated by the flexure of lip 19. The portion of the inner shell 12 nearest the tube sheet 32, when deflected, tends to pivot substantially about its point of attachment to the outer shell 14. This deflection of the inner shell 12 is facilitated by positioning the exhaust opening 36 some distance away from the combustion chamber opening 18 or any other points where the inner shell 12 and the outer shell 14 are joined.

Additionally, disposing the combustion chamber axis 50 and the flue tube axis 52 substantially perpendicular facilitates deflection of the inner shell.

A further advantage of this embodiment of the present invention is that the flue tubes 26 can provide support for the inner shell 12. In addition to the support provided by the flue tubes 26, the inner shell 12 may be supported by an optional biasing element 58, such as a spring.

In an alternative embodiment, the inner shell 12 can be made difficult enough to deflect, and the flue tubes 26 can be flexible enough, to cause the flue tubes 26 to flex, as well as deflecting the inner shell 12, when the flue tubes 26 thermally expand. This provides a second means for accommodating the thermal expansion and contraction of the flue tubes 26. The thermal expansion of the inner shell 12 can also be accomodated by flexure of the flue tubes 26.

While particular embodiments of the invention have been shown, it will be understood that the invention is not limited thereto, since modifications may be made by those skilled in the art, particularly in light of the foregoing teachings. It is, therefore, contemplated by the appended claims to cover any such modifications which are within the true spirit and scope of the invention.

What is claimed is:

1. A fluid heater comprising:

A. an inner shell defining a combustion chamber;

B. an outer shell surrounding at least a portion of said inner shell and having an aperture;

C. a reservoir defined at least in part by said inner shell and said outer shell for containing a fluid to be heated; and D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell, wherein said flue tube is positioned to deflect said inner shell with respect to said outer shell along said axis as a result of a thermal expansion of said flue tube.

2. The fluid heater of claim 1, wherein said inner shell is attached to said outer shell at a point spaced from said inlet of said flue tube.

3. A fluid heater comprising:

A. an inner shell defining a combustion chamber;

B. an outer shell surrounding at least a portion of said inner shell and having an aperture;

C. a reservoir defined at least in part said inner shell and said outer shell for containing a fluid to be heated; and D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell;

wherein, responsive to the thermal expansion of said flue tube along said axis, said inner shell is deflected with respect to said outer shell; and wherein said inner shell is attached to said outer shell at a point spaced from said inlet of said fluid tube by a common wall, the common wall having an aperture for the introduction of a flame into the combustion chamber.

4. A fluid heater comprising:

A. an inner shell defining a combustion chamber;

B. an outer shell surrounding at least a least a portion of said inner shell and having an aperture;

C. a reservoir defined at least in part by said inner shell and said outer shell for containing a fluid to be heated; and D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell;

wherein, responsive to the thermal expansion of said flue tube along said axis, said inner shell is deflected with respect to said outer shell; and wherein:

E. said inner shell has a lip defining an opening;

F. said outer shell has a lip defining an opening; and

G. the lip of said inner shell and the lip of said outer shell are joined at a region spaced from said inlet of said flue tube;

thereby defining a combustion chamber opening for the introduction of a flame into said combustion chamber.

5. The fluid heater of claim 4, further comprising a generally annular element connecting the lip of said inner shell to the lip of said outer shell.

6. The fluid heater of claim 1, wherein said inner shell comprises a re-entrant portion of said outer shell.

7. The fluid heater of claim 1, wherein said at least one flue tube comprises a plurality of flue tubes.

8. The fluid heater of claim 1, wherein said flue tube provides support for said inner shell.

9. A fluid heater comprising:

A. an inner shell defining a combustion chamber;

B. an outer shell surrounding at least a portion of said inner shell and having an aperture;

C. a reservoir defined at least in part by said inner shell and said outer shell for containing a fluid to be heated;

D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell;

wherein, responsive to the thermal expansion of said flue tube along said axis, said inner shell is deflected with respect to said outer shell; and E. a biasing element for reducing said deflection of said inner shell.

10. The fluid heater of claim 1, wherein said inner and outer shells are generally cylindrical and generally concentric about a common axis.

11. A fluid heater comprising:

A. an inner shell defining a combustion chamber;

B. an outer shell surrounding at least a portion of said inner shell and having an aperture;

C. a reservoir defined at least in part by said inner shell and said outer shell for containing a fluid to be heated; and D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell wherein, responsive to the thermal expansion of said flue tube along said axis, said inner shell is deflected with respect to said outer shell; and wherein said inner and outer shells are generally cylindrical and generally concentric about a common axis; and wherein said axis connecting said inlet and said outlet is substantially perpendicular to said common axis.

12. The fluid heater of claim 11, further comprising; a stack which defines at least a portion of said reservoir, said stack comprising a generally cylindrical portion of the outer shell extending radially outward relative to said common axis, said stack having a proximal end and a distal end relative to said common axis; wherein the aperture of said outer shell is located in the distal end of said stack.

13. The fluid heater of claim 1, wherein said flue tube is flexible so at least a portion of said thermal expansion of said flue tube is accommodated by flexion of said flue tube.

14. The fluid heater of claim 13, wherein said inner shell thermally expands, and the thermal expansion of said inner shell is at least partially accommodated by flexion of said flue tube.

15. A fluid heater comprising:

A. an inner shell defining a combustion chamber;

B. an outer shell surrounding at least a portion of said inner shell and having an aperture;

C. a reservoir defined at least in part by said inner shell and said outer shell for containing a fluid to be heated; and D. at least one thermally expandable flue tube having an inlet, an outlet, and an axis passing through said inlet and said outlet and defining a direction of thermal expansion of said flue tube, the inlet of said flue tube being connected to said inner shell and communicating with said combustion chamber, and the outlet of said flue tube being connected to said outer shell and communicating through the aperture in said outer shell; and E. means for responding to the thermal expansion of said flue tube along said axis by allowing said inner shell to deflect with respect to said outer shell.

* * * * *